US005699070A

United States Patent [19]

Mischenko et al.

[11] Patent Number: 5,699,070

[45] Date of Patent: *Dec. 16, 1997

[54] RADIO HAVING REPLACEABLE AND RETRACTABLE ANTENNA APPARATUS

[75] Inventors: Nicholas Mischenko, Mt. Prospect; Steven C. Emmert, Arlington Heights, both of Ill.

[73] Assignee: Motorola, Inc., Schaumburg, Ill.

[ * ] Notice: The term of this patent shall not extend beyond the expiration date of Pat. No. 5,243,355.

[21] Appl. No.: 391,292

[22] Filed: Feb. 21, 1995

Related U.S. Application Data

[63] Continuation of Ser. No. 927,086, Aug. 7, 1992, abandoned, which is a continuation-in-part of Ser. No. 663,974, Mar. 4, 1991, abandoned.

[51] Int. Cl.[6] ..... H01Q 1/24; H01Q 1/10; H01Q 1/36

[52] U.S. Cl. ..... 343/702; 343/895; 343/901

[58] Field of Search ..... 343/702, 895, 343/900, 901, DIG. 1; H01Q 1/24, 1/10, 1/36

[56] References Cited

U.S. PATENT DOCUMENTS

| | | | |
|---|---|---|---|
| 2,214,685 | 9/1940 | Stone, Jr. | 343/901 |
| 3,675,616 | 7/1972 | McInnis | 343/901 |
| 4,087,820 | 5/1978 | Henderson | 343/895 |
| 4,121,218 | 10/1978 | Irwin et al. | 343/702 |
| 4,725,845 | 2/1988 | Phillips | 343/702 |
| 4,868,576 | 9/1989 | Johnson, Jr. | 343/702 |
| 4,920,354 | 4/1990 | Rauser et al. | 343/901 |
| 5,168,278 | 12/1992 | Morita | 343/702 |
| 5,243,355 | 9/1993 | Emmert et al. | 343/895 |
| 5,258,772 | 11/1993 | Inanaga et al. | 343/895 |
| 5,274,393 | 12/1993 | Scott | 343/702 |

FOREIGN PATENT DOCUMENTS

| | | | |
|---|---|---|---|
| 0532960A1 | 3/1993 | European Pat. Off. | H04B 1/38 |

OTHER PUBLICATIONS

Owner's Manual, AT&T Cordless Telephone 5500, 1988, #5242B, printed in Singapore, 1988.

*Primary Examiner*—Hoanganh T. Le
*Attorney, Agent, or Firm*—Kevin D. Kaschke

[57] ABSTRACT

An antenna assembly (200) for use in a portable radio (100). The antenna assembly (200) includes first and second housings (113 and 203), a helical antenna (301) and a terminal (205). The first housing (113) is telescopically moveable with respect to the second housing (203) between a retracted and an extended position. The helical antenna (301) has a first dimension when the first housing (113) is moved to the first position and a second dimension when the first housing (113) is moved to the second position. The terminal (205) is coupled to the helical antenna (301) for replaceably coupling to the portable radio (100) by a user. Additionally, a pin (303), covered with a thickened solution (304), is disposed within the helical antenna (301)to dampen mechanical vibrations of the helical antenna (301) and a detenting mechanism retains the first housing (113) in the first and the second positions.

57 Claims, 3 Drawing Sheets

RADIO HAVING REPLACEABLE AND RETRACTABLE ANTENNA APPARATUS

RELATED APPLICATIONS

This is a continuation of application Ser. No. 07/927,086, filed Aug. 7, 1992 and now abandoned which is a continuation in part of application Ser. No. 663,974, entitled "Semi-automatic Retractable Antenna Apparatus", filed on Mar. 4, 1991 and assigned to the assignee of the present invention, now abandoned.

FIELD OF THE INVENTION

The present invention relates generally to antennas and more particularly to a antennas for portable radios.

BACKGROUND OF THE INVENTION

Antennas for use with portable radios, such as cordless radiotelephones or cellular radiotelephones, are well known in the art. Because such radios are indeed portable, prior art antennas have been designed with, among other considerations, portability, replaceability, and durability in mind.

One prior art antenna is a rod antenna disclosed in U.S. Pat. No. 4,121,218. The rod antenna is formed of metallic telescoping sections which may be telescoped together in a small space for increased portability and which may be readily extended for increased signal performance. Further, some rod antennas have been supplied with a threaded terminal at one end of the rod antenna so that a user can replaceably couple the rod antenna to the radio. However, the metallic telescoping sections are somewhat fragile enabling them to be frequently bent or broken when extended resulting in the expense and inconvenience of replacing the rod antenna.

Other prior art antennas comprise a helical antenna formed from a helical wire coil covered with an insulating cover. Some helical antennas have spring type coils that cause the insulating cover to retract or extend, such as an antenna disclosed in U.S. Pat. No. 4,725,845. Although such antennas are more durable than the rod antennas and retractable, they are not designed to be replaced by the user.

Other helical antennas have rigid coils having a connector at one end for coupling to a mating connector on the radio. Such an antenna, No. SAF4140A, available from Motorola Inc., is commonly provided for cellular portable radiotelephones. Although such an antennas are easily replaceable and relatively durable, they are not retractable.

Another helical antenna having a fixed coil is retractable and relatively durable but is not replaceable, such as disclosed in U.S. Pat. No. 4,868,576.

Therefore, there is a need for an antenna for use in a portable radio that is retractable and replaceable as well as durable. Further, the antenna should be easy to manufacture and provide acceptable signal performance for the radio.

SUMMARY OF THE INVENTION

An antenna assembly comprises a housing, an antenna, and a terminal. The housing has a first and second portion. The first housing portion is telescopically moveable with respect to the second housing portion between a stowed position and an unstowed position. The antenna, formed of a resilient helical coil, has a compressed state within the first and second housing portions when the first housing portion is moved to the stowed position, and an expanded state within the first and second housing portions when the first housing portion is moved to the unstowed position. The terminal is coupled to the antenna.

Further, the antenna assembly may be replaceably coupled to a portable radio by a user.

DETAILED DESCRIPTION OF A PREFERRED EMBODIMENT

Figure 1:
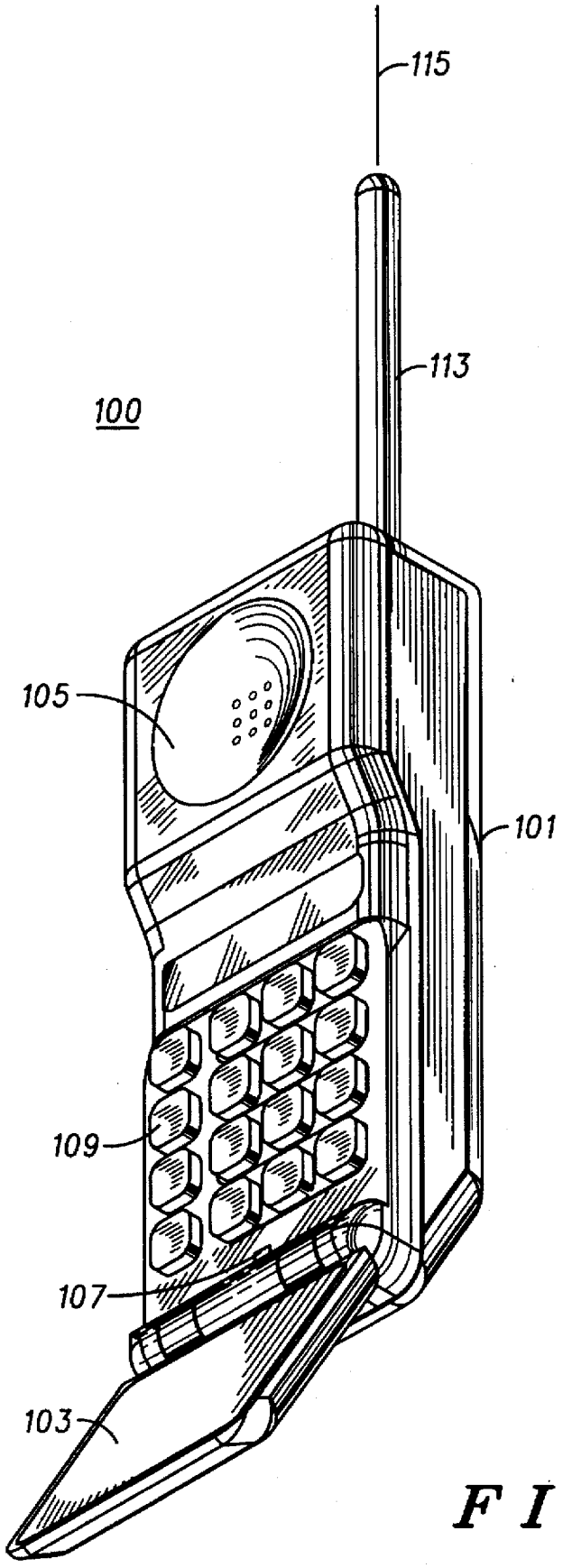
FIG. 1 is a perspective view of a portable radiotelephone constructed in accordance with the present invention.

Referring now to the drawings, FIG. 1 shows a perspective view of a portable radiotelephone 100 (hereinafter referred to as the "radio") adapted for use in a cordless radiotelephone system and constructed in accordance with the present invention. Such a radio 100 is manufactured and available from Motorola Inc. under model No. S2356D.

In general, the radio 100 comprises a main housing 101, a flip element 103, an earpiece 105, a microphone 107, a keypad 109 and a portion of an antenna assembly 113. The flip element 103 is rotatably coupled to the main housing 101 such that the keypad 109 and microphone 107 are covered by the flip element 103 when the radio 100 is not in use and uncovered when the radio 100 is in use. The user may listen via earpiece 105 and speak into the microphone 107. The keypad consist of a plurality of buttons numbered one thru zero, # and * in a familiar telephone arrangement as well as additional function buttons such as "off", "phone/flash" and other numbers associated with memory recall, The portion of the antenna assembly 113 couples radio frequency (RF) signals between the radio 100 and the cordless radiotelephone system and is moveable along the longitudinal axis of the portion of the antenna assembly 113 as represented by line 115. The portion of the antenna assembly 113 in FIG. 1 is shown extended beyond the main housing 101 for increased RF signal performance but may also be substantially retracted inside the main housing 101 for increased portability.

Figure 2:
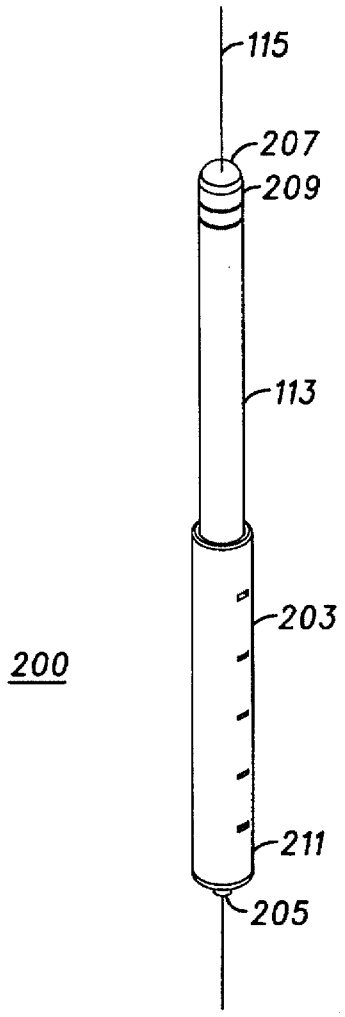
FIG. 2 is a perspective view of an antenna assembly for use with the portable radiotelephone of FIG. 1.

FIG. 2 is a perspective view of an assembled antenna assembly 200 for use with the radio 100 of FIG. 1. In general the antenna assembly 200 externally comprises a first tubular housing 113 (i.e. the antenna portion), a second tubular housing 203, a cap 207 and a terminal 205. The first housing 113 is telescopically moveable with respect to the second housing 203 between an extended and a retracted position (further discussed in FIG'S. 4 and 5). The cap 207 covers a distal end portion 209 of the first housing 113. The terminal 205 is coupled to a distal end portion 211 of the second housing 203.

Figure 3:
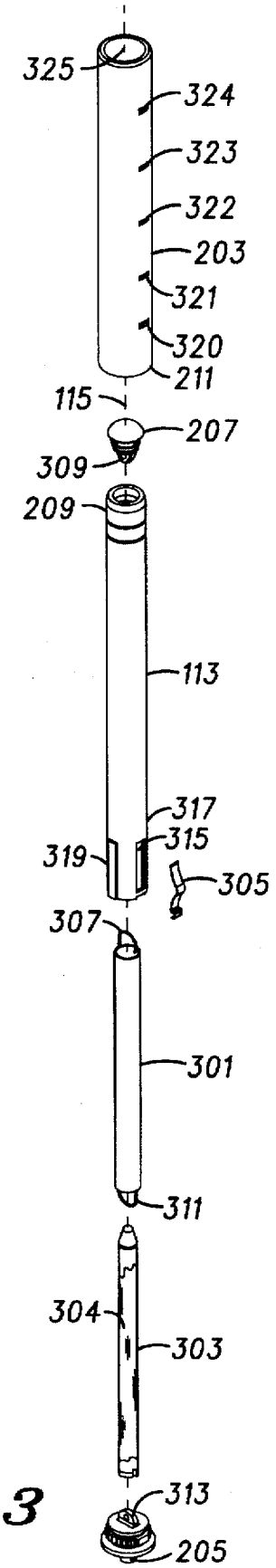
FIG. 3 is in an exploded perspective view of the antenna assembly of FIG. 2.

FIG. 3 is in an exploded perspective view of the antenna assembly 200 of FIG. 2. In general, the elements of the antenna assembly comprise the externally visible elements shown in FIG. 2 as well as other internal elements such as a helical antenna 301, a pin 303 and a leaf spring 305.

One end of the helical antenna 307 is coupled to the cap 207 via an eyelet 309. The helical antenna 301 is disposed inside the first housing 113 so that the cap 207 may be secured to the distal end portion 209 of the first housing 113. The pin 303, substantially covered with a thickened solution 304, such as a gel, is disposed inside the helical antenna 301. The pin 303 has a diameter slightly smaller than the inside diameter of the helical antenna 301. The other end 311 of the helical antenna 301 is coupled, via conventional soldering methods, to a ring 313 on the terminal 205.

The helical antenna 301 has dimensions and characteristics to provide acceptable signal performance for the radio 100.

The spring 305, arched in its center, is placed in a recess 315 in the surface of the first housing 113 near a second end portion 317 opposite the distal end portion 209. The first housing 113 is disposed within the second housing 203 such that at least one guide rail 319, also at the second end portion 317, lines up with a mating slot (not shown) longitudinally disposed on the inside wall of the second housing 203. The recess 315 is spaced relative to the guide rail 319 on the first housing 113 such that the spring 305 is longitudinally aligned with holes 320–324 disposed in the wall of the second housing 203.

With the first housing 113 fully inserted into the second housing 203, the distal end portion 211 of the second housing 203 is coupled to the terminal 205 using a conventional coupling technique, such as ultrasonic welding. When the antenna assembly 200 is fully assembled, the first housing 113 is somewhat longer than the second housing 203 so that the distal end portion 209 of the first housing 113 extends beyond the second housing 203 in its fully retracted position to accommodate manual positioning of the first housing 113.

FIG'S. 4 and 5 are partial longitudinal cross-sectional views of the antenna assembly of FIG. 2 coupled to the radio 100 in a retracted and an extended position, respectively. FIG'S. 4 and 5 are viewed together to fully describe the operation of the antenna apparatus 200 in cooperation with the radio 100.

The terminal end portion 211 of the antenna assembly 200 is inserted into a hole 401 in the main housing 101 having a diameter slightly larger than the diameter of the second housing 203. The antenna assembly 200 is fully inserted when a threaded stud 403 on the terminal 205 hits a plate 405 having a mating threaded hole disposed therein. The threaded stud 403 may be screwed into the threaded hole in the plate 405 by turning the first housing portion 113. When the threaded connection is complete the second housing 203 is approximately flush with the main housing 101 near the hole 401 to provide a neat external radio appearance. Further, the first housing 113 is extended somewhat beyond the main housing 101 when fully retracted inside the second housing 203 portion to facilitate manual extension and retraction of the first housing 113 by the user. This method for coupling the antenna assembly 200 to the radio 100 is performed easily and without error by the user of the radio 100 in the event that the antenna assembly 200 needs to be replaced.

The plate 405 is conventionally coupled to a printed circuit board 407 using a screw 409 or otherwise soldered. The printed circuit board has coupled to it, among other components, a transceiver represented by block 411. Hence, the radio 100 transmits and receives RF signals via the helical antenna 301.

The antenna assembly 200 may alternatively be coupled to the radio 100 without the use of the terminal 205 using conventional capacitive of inductive coupling mechanisms.

The helical antenna 301 has spring-type characteristics of a resilient helical coil of wire. As the first housing 113 is manually retracted and extended, the helical coil 301 contracts to a short longitudinal dimension and expands to a long longitudinal dimension, respectively. At all times a minimum pitch between adjacent coils of the helical antenna 301 is maintained to prevent electrical shorting of the adjacent coils which would shorten the total wire length of the helical antenna.

Since the helical antenna 301 is resilient, a retaining mechanism is needed to retain the position of the first housing 113 in spite of the contracting bias forces applied by the helical antenna 301. The spring 305 in cooperation with any one of the holes 320–324 in the wall of the second housing 203 comprises a detenting mechanism for retaining the first housing 113 in any one of five positions corresponding to the relative position of the holes 320–324.

Since the helical antenna 301 is resilient, mechanical vibrations of the radio 100 during use can cause well known microphonics to be generated in the radio circuitry. The pin 303 serves to dampen mechanical vibration of the helical antenna 301 primarily in a radial direction perpendicular to the longitudinal axis 115. The thickened solution 304, disposed on the pin 303, further aids the pin in reducing the mechanical vibration of the helical antenna 301 in both the radial direction and the longitudinal direction.

An alternative embodiment includes a substantially rigid helical coil substantially disposed within the first housing portion and a substantially resilient helical coil substantially disposed within the second housing portion. The rigid and resilient helical coils are axially aligned in tandem within the first and second housings 113 and 203. One end of the resilient helical coil is coupled to the terminal means and the other end is coupled to the rigid helical coil using conventional coupling methods such as soldering. This alternate embodiment provides an even more durable antenna within the extended first housing 113 while also having the retractable and replaceable features described above.

Figure 6:
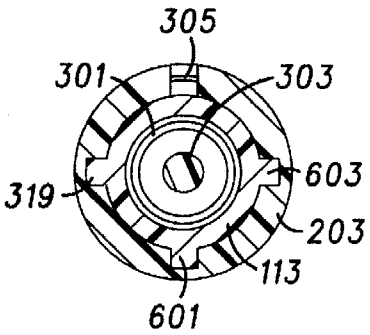
FIG. 6 is a lateral cross-sectional view of the antenna assembly of FIG. 2, FIG. 4 or FIG. 5.
Figure 4:
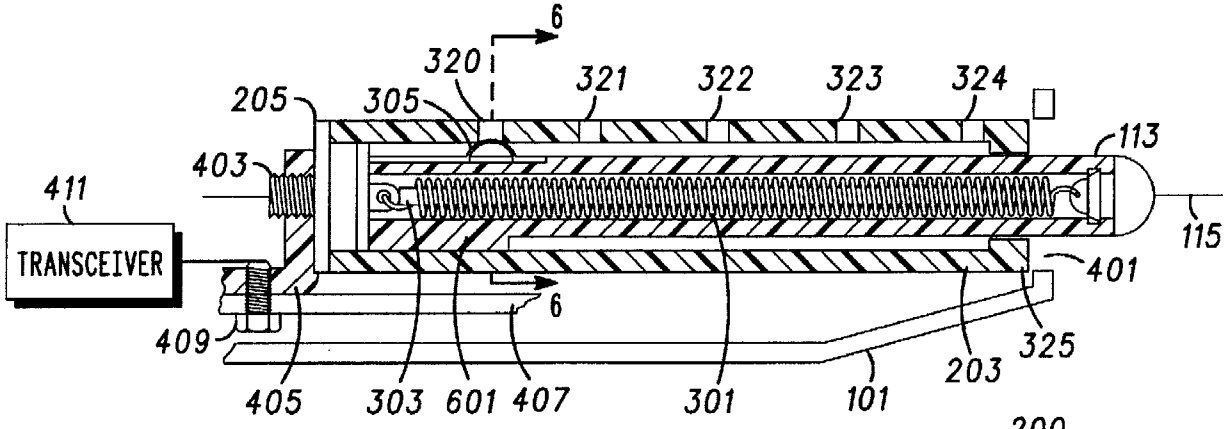
FIG. 4 is a partial longitudinal cross-sectional view of the antenna assembly of FIG. 2 coupled to a radio and in a retracted position.
Figure 5:
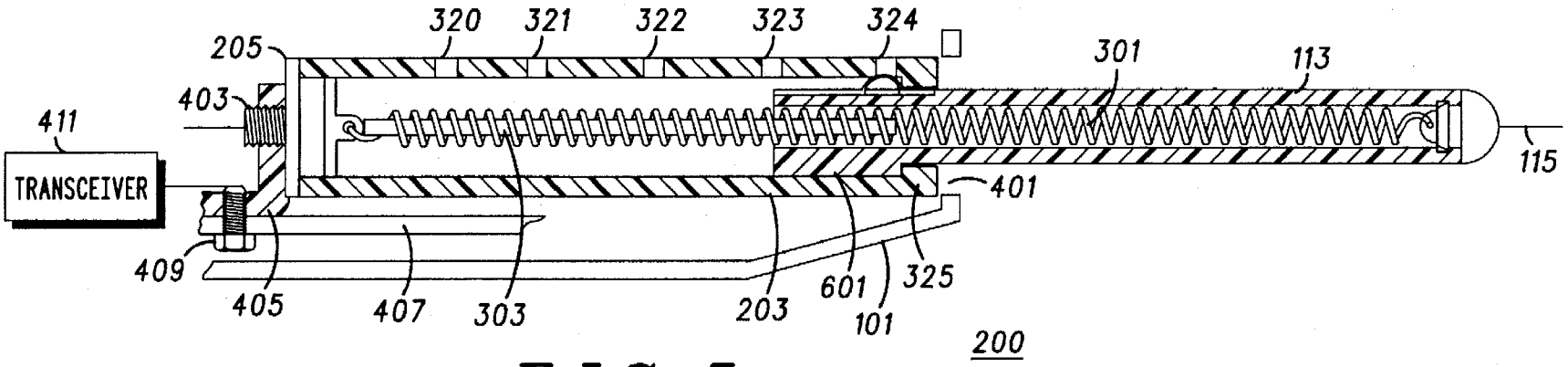
FIG. 5 is a partial longitudinal cross-sectional view of the antenna assembly of FIG. 2 coupled to a radio and in an extended position.

FIG. 6 is a lateral cross-sectional view of the antenna assembly of FIG. 2, FIG. 4 or FIG. 5. The guide rail 319, 601 and 603 extending beyond the surface of the first housing 113 has several purposes. One purpose is to secure the axial rotation of the first housing 113 relative to the second housing 203. This enables the user to axially spin the first housing 113 to replaceably couple the antenna assembly 200 to to the radio 100 as described above. Another purpose is to protected the helical antenna 301 from damage due to consecutive rotational turns of the first housing 113. And still another purpose is to limit the telescopic movement of the first housing 113 beyond an end portion 325 of the second housing 203. (Best seen in FIG. 5) Such limited travel prevents a user from overextending the first housing 113 causing destructive damage to the helical antenna 301.

Thus, an antenna assembly 200 has been described for use in a portable radio 100 that is retractable and replaceable as well as durable. Further, the antenna is easy to manufacture and provides acceptable signal performance for the radio.

We claim:

1. An antenna assembly comprising:

a housing having a first housing portion and a second housing portion, the first housing portion being telescopically moveable with respect to the second housing portion between a stowed position and an unstowed position;

an antenna, formed of a continuous resilient helical coil, for transmitting or receiving signals, the antenna having a compressed state within both the first housing portion and second housing portion when the first housing portion is moved to the stowed position and having an expanded state within both the first housing portion and second housing portion when the first housing portion is moved to the unstowed position; and a terminal coupled to the antenna.

2. An antenna apparatus in accordance with claim 1 wherein a user of a radio is capable of replaceably coupling the antenna apparatus to the radio.

3. An antenna apparatus in accordance with claim 1 further comprising:

means for dampening vibration of the antenna.

4. An antenna apparatus in accordance with claim 3 wherein the means for dampening further comprises:

a pin axially disposed within the antenna formed of the resilient helical coil.

5. An antenna apparatus in accordance with claim 4 wherein the means for dampening further comprises:

a thickened solution disposed on the pin.

6. An antenna apparatus in accordance with claim 1 further comprising:

means for securing the axial rotation of the first housing portion relative to the second housing portion.

7. An antenna apparatus in accordance with claim 1 further comprising:

an end cap covering a distal end portion of the first housing portion and coupled to the antenna.

8. An antenna apparatus in accordance with claim 1 further comprising:

means for retaining the first housing portion in at least one of the stowed position and the unstowed position.

9. An antenna apparatus in accordance with claim 1 further comprising:

means for limiting movement of the first housing portion with respect to the second housing portion along a longitudinal axis of the first housing portion and the second housing portion.

10. An antenna apparatus in accordance with claim 1 further comprising:

means for coupling the terminal to a distal end portion of the second housing portion.

11. A radio comprising:

a radio housing;

an antenna apparatus comprising:

a housing having a first housing portion and a second housing portion, the second housing portion being disposed substantially inside the radio housing, the first housing portion being telescopically moveable with respect to the second housing portion between a stowed position located substantially inside the radio housing and an unstowed position located substantially outside the radio housing; and an antenna, formed of a continuous resilient helical coil, for transmitting or receiving signals, the antenna having a compressed state within both the first housing portion and second housing portion when the first housing portion is moved to the stowed position and having an expanded state within both the first housing portion and second housing portion when the first housing portion is moved to the unstowed position;

a transmitter disposed in the radio housing and coupled to the antenna; and a receiver disposed in the radio housing and coupled to the antenna.

12. A radio in accordance with claim 11 wherein a user of the radio is capable of replaceably coupling the antenna apparatus to the radio.

13. A radio in accordance with claim 11 wherein the antenna apparatus further comprises:

means for dampening vibration of the antenna.

14. A radio in accordance with claim 13 wherein the means for dampening further comprises:

a pin axially disposed within the antenna formed of the resilient helical coil.

15. A radio in accordance with claim 14 wherein the means for dampening further comprises:

a thickened solution disposed on the pin.

16. A radio in accordance with claim 11 wherein the antenna apparatus further comprises:

means for securing the axial rotation of the first housing portion relative to the second housing portion.

17. A radio in accordance with claim 11 wherein the antenna apparatus further comprises:

an end cap covering a distal end portion of the first housing portion and coupled to the antenna.

18. A radio in accordance with claim 11 wherein the antenna apparatus further comprises:

means for retaining the first housing portion in at least one of the stowed position and the unstowed position.

19. A radio in accordance with claim 11 wherein the antenna apparatus further comprises:

means for limiting movement of the first housing portion with respect to the second housing portion along a longitudinal axis of the first housing portion and the second housing portion.

20. A radio in accordance with claim 11 wherein the antenna apparatus further comprises:

a terminal coupled to a distal end portion of the second housing portion.

21. An antenna assembly comprising:

a first housing portion having a proximal end and a distal end;

a second housing portion having a proximal end and a distal end, the proximal end of the first housing portion being telescopically moveable with respect to the distal end of the second housing portion between a stowed position and an unstowed position;

a terminal having a first end disposed opposite a second end, the terminal being coupled to the proximal end of the second housing portion; and an antenna having a first end disposed opposite a second end, the antenna being formed of a continuous resilient helical coil, the first end of the antenna being coupled to the distal end of the first housing portion, the second end of the antenna being coupled to the first end of the terminal, at least a portion of the antenna being compressed when the first housing portion is moved to the stowed position and being expanded when the first housing portion is moved to the unstowed position.

22. An antenna apparatus in accordance with claim 21 wherein the second end of the terminal further comprises:

a connector adapted for coupling to and decoupling from radio circuitry disposed in a radio housing.

23. An antenna apparatus in accordance with claim 21 further comprising:

means for dampening vibration of the antenna.

24. An antenna apparatus in accordance with claim 23 wherein the means for dampening further comprises:

a pin axially disposed within the antenna formed of the resilient helical coil.

25. An antenna apparatus in accordance with claim 24 further comprising a thickened solution disposed on the pin.

26. An antenna apparatus in accordance with claim 21 further comprising:

means for securing the axial rotation of the first housing portion relative to the second housing portion.

27. An antenna apparatus in accordance with claim 21 further comprising:

an end cap attached to the distal end of the first housing portion and connected to the first end of the antenna.

28. An antenna apparatus in accordance with claim 21 further comprising:

means for retaining the first housing portion in at least one of the stowed position and the unstowed position.

29. An antenna apparatus in accordance with claim 21 further comprising:

means for limiting the movement of the first housing portion with respect to the second housing portion.

30. An antenna apparatus in accordance with claim 21 further comprising:

means for coupling the terminal to a distal end portion of the second housing portion.

31. An antenna apparatus in accordance with claim 21 wherein the antenna is compressed within both the first housing portion and the second housing portion when the first housing portion is moved to the stowed position, and wherein the antenna is expanded within both the first housing portion and the second housing portion when the first housing portion is moved to the unstowed position.

32. A radio comprising:

a radio housing;

a radio transceiver disposed in the radio housing; and an antenna assembly comprising:

a first housing portion having a proximal end and a distal end;

a second housing portion having a proximal end and a distal end, the second housing portion being disposed substantially inside the radio housing, the proximal end of the first housing portion being telescopically moveable with respect to the distal end of the second housing portion between a stowed position located substantially inside the radio housing and an unstowed position located substantially outside the radio housing; and an antenna having a first end disposed opposite a second end, the antenna being formed of a continuous resilient helical coil, the first end of the antenna being coupled to the distal end of the first housing portion, the second end of the antenna being coupled to the radio transceiver, at least a portion of the antenna being compressed when the first housing portion is moved to the stowed position and being expanded when the first housing portion is moved to the unstowed position.

33. An antenna apparatus in accordance with claim 32 further comprising:

a terminal, coupled to the proximal end of the second housing portion, providing a connector adapted for coupling to and decoupling from the radio transceiver.

34. An antenna apparatus in accordance with claim 32 further comprising:

means for dampening vibration of the antenna.

35. An antenna apparatus in accordance with claim 34 wherein the means for dampening further comprises:

a pin axially disposed within the antenna formed of the resilient helical coil.

36. An antenna apparatus in accordance with claim 35 wherein the means for dampening further comprises:

a thickened solution disposed on the pin.

37. An antenna apparatus in accordance with claim 32 further comprising:

means for securing the axial rotation of the first housing portion relative to the second housing portion.

38. An antenna apparatus in accordance with claim 32 further comprising:

an end cap attached to the distal end of the first housing portion and connected to the first end of the antenna.

39. An antenna apparatus in accordance with claim 32 further comprising:

means for retaining the first housing portion in at least one of the stowed position and the unstowed position.

40. An antenna apparatus in accordance with claim 32 further comprising:

means for limiting movement of the first housing portion with respect to the second housing portion along a longitudinal axis of the first housing portion and the second housing portion.

41. An antenna apparatus in accordance with claim 32 wherein the antenna is compressed within both the first housing portion and the second housing portion when the first housing portion is moved to the stowed position, and wherein the antenna is expanded within both the first housing portion and the second housing portion when the first housing portion is moved to the unstowed position.

42. An antenna assembly comprising:

a first cylindrical housing portion having a proximal end and a distal end;

a second cylindrical housing portion having a proximal end and a distal end, the proximal end of the first cylindrical housing portion being telescopically moveable along a longitudinal axis with respect to the distal end of the second cylindrical housing portion between a stowed position and an unstowed position;

means for securing an axial rotation about the longitudinal axis of the first housing portion relative to the second housing portion;

means for retaining the first housing portion in at least one of the stowed position and the unstowed position;

means for limiting movement of the first housing portion with respect to the second housing portion along the longitudinal axis;

an end cap attached to the distal end of the first housing portion;

a terminal having a first end disposed opposite a second end, the terminal being coupled to the proximal end of the second housing portion, the second end of the terminal providing a connector adapted for coupling to and decoupling from radio circuitry; and an antenna having a first end disposed opposite a second end, the antenna being formed of a continuous resilient helical coil, the first end of the antenna being coupled to the end cap, the second end of the antenna being coupled to the first end of the terminal, at least a portion of the antenna being compressed when the first housing portion is moved to the stowed position and being expanded when the first housing portion is moved to the unstowed position.

43. An antenna apparatus in accordance with claim 42 further comprising:

means for dampening vibration of the antenna.

44. An antenna apparatus in accordance with claim 43 wherein the means for dampening further comprises:

a pin axially disposed within the antenna formed of the resilient helical coil.

45. An antenna apparatus in accordance with claim 44 wherein the means for dampening further comprises:

a thickened solution disposed on the pin.

46. An antenna apparatus in accordance with claim 44 wherein the at least a portion of the antenna is compressed within both the first housing portion and the second housing portion when the first housing portion is moved to the stowed position, and wherein the at least a portion of the antenna is expanded within both the first housing portion and the second housing portion when the first housing portion is moved to the unstowed position.

47. An antenna assembly comprising:

a first nonconductive housing portion;

a second nonconductive housing portion, the first nonconductive housing portion being telescopically moveable with respect to the second nonconductive housing portion between a stowed position and an unstowed position;

an antenna adapted to transmit and receive signals, at least a portion of the antenna having a retracted state within at least one of the first nonconductive housing portion and second nonconductive housing portion when the first nonconductive housing portion is moved to the stowed position and having an extended state within at least one of the first nonconductive housing portion and second nonconductive housing portion when the first nonconductive housing portion is moved to the unstowed position; and a terminal electrically coupled to the antenna and mechanically coupled to the second nonconductive housing portion, the terminal being adapted for mechanically coupling the first nonconductive housing portion and the second nonconductive housing portion to a radio housing of a radio handset, the terminal being adapted for electrically coupling the antenna to radio circuitry disposed in the radio housing of the radio handset, the terminal being constructed to permit installation and replacement of the antenna assembly with the radio handset via a hole disposed in the radio housing of the radio handset without disassembling the radio handset.

48. An antenna apparatus in accordance with claim 47 wherein the antenna being formed of a continuous resilient helical coil.

49. An antenna apparatus in accordance with claim 47 further comprising:

means for dampening vibration of the antenna.

50. An antenna apparatus in accordance with claim 49 wherein the means for dampening further comprises:

a pin axially disposed within the antenna formed of the resilient helical coil.

51. An antenna apparatus in accordance with claim 50 further comprising a thickened solution disposed on the pin.

52. An antenna apparatus in accordance with claim 47 further comprising:

means for securing the axial rotation of the first housing portion relative to the second housing portion.

53. An antenna apparatus in accordance with claim 47 further comprising:

an end cap attached to a distal end of the first housing portion and connected to a first end of the antenna.

54. An antenna apparatus in accordance with claim 47 further comprising:

means for retaining the first housing portion in at least one of the stowed position and the unstowed position.

55. An antenna apparatus in accordance with claim 47 further comprising:

means for limiting the movement of the first housing portion with respect to the second housing portion.

56. An antenna apparatus in accordance with claim 47 further comprising:

means for coupling the terminal to a distal end portion of the second housing portion.

57. An antenna apparatus in accordance with claim 47 wherein the antenna is compressed within both the first housing portion and the second housing portion when the first housing portion is moved to the stowed position, and wherein the antenna is expanded within both the first housing portion and the second housing portion when the first housing portion is moved to the unstowed position.

* * * * *